United States Patent [19]

Tripp

[11] Patent Number: 4,879,852

[45] Date of Patent: Nov. 14, 1989

[54] APPARATUS FOR MAINTAINING SOIL MOISTURE

[76] Inventor: Kenneth C. Tripp, 2712 Jennifer Cir., College Station, Tex. 77840

[21] Appl. No.: 305,775

[22] Filed: Feb. 3, 1989

[51] Int. Cl.[4] ..... E02D 31/00; B05B 1/14

[52] U.S. Cl. ..... 52/169.5; 239/63; 239/562; 138/115; 138/116; 405/37; 405/258

[58] Field of Search ..... 52/169.1, 169.5; 405/36, 229, 37, 43, 40, 258; 239/63, 200, 207, 208, 282, 99, 66, 443, 444, 562; 138/115, 116, 103, 37, 39, 42

[56] References Cited

U.S. PATENT DOCUMENTS

| | | | |
|---|---|---|---|
| 15,647 | 9/1856 | Driggs | 239/200 |
| 1,620,142 | 3/1927 | Thompson | 239/208 |
| 1,693,556 | 11/1929 | Spencer | 239/208 |
| 2,753,215 | 7/1956 | Barr | 239/562 |
| 2,757,965 | 8/1956 | Andrews | 239/207 |
| 2,768,028 | 10/1956 | Robinson | 239/63 |
| 3,024,372 | 3/1962 | Seebe | 239/63 |
| 3,574,338 | 4/1971 | Shelor | 239/562 |
| 3,874,590 | 4/1975 | Gibson | 239/63 |
| 4,293,237 | 10/1981 | Robey et al. | 405/43 |
| 4,534,143 | 8/1985 | Goines et al. | 52/169.1 |
| 4,545,528 | 10/1985 | Perez | 239/208 |

FOREIGN PATENT DOCUMENTS

| | | | |
|---|---|---|---|
| 1340665 | 9/1987 | U.S.S.R. | 239/63 |

*Primary Examiner*—David A. Scherbel
*Assistant Examiner*—Caroline D. Dennison
*Attorney, Agent, or Firm*—Richard C. Litman

[57] ABSTRACT

An apparatus is described that has been created to maintain a constant level of saturation of water near the foundation of houses, buildings, or the like. The maintenance of such a level of moisture is essential to the structural integrity of foundations especially in those geographic locations where the level of soil moisture varies significantly from season to season. Soil, when it absorbs water, expands. This soil can exert tremendous pressure on the foundation of a house. To prevent cracking of foundations, and thus, to prevent the need for costly repairs, the apparatus described herein provides sufficient moisture to the soil surrounding the foundation of a house such that additional moisture (i.e. rain) does not cause the soil to expand dramatically.

8 Claims, 3 Drawing Sheets

FIG. 3
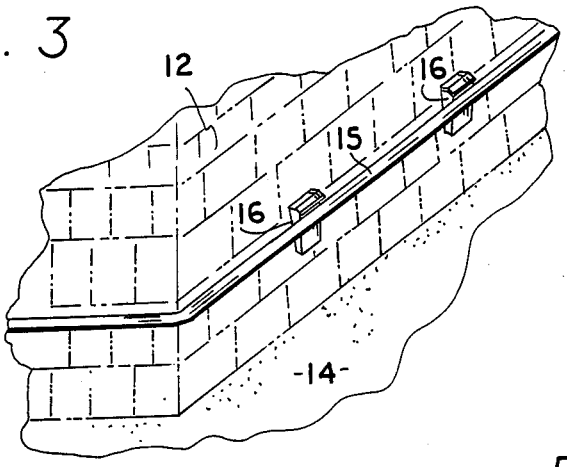
FIG. 4
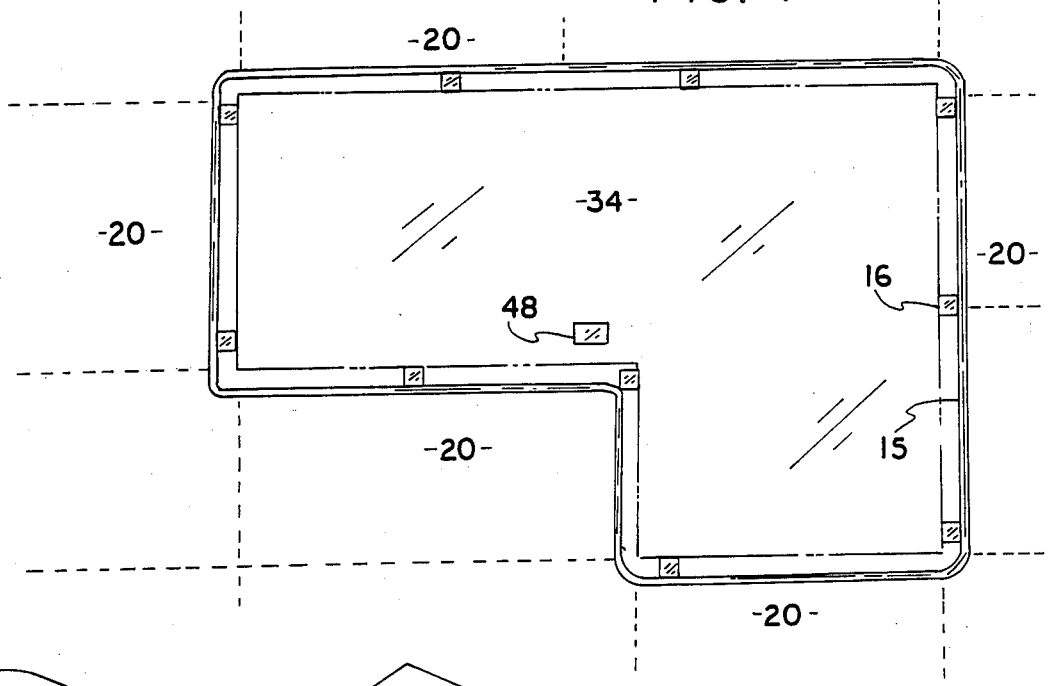
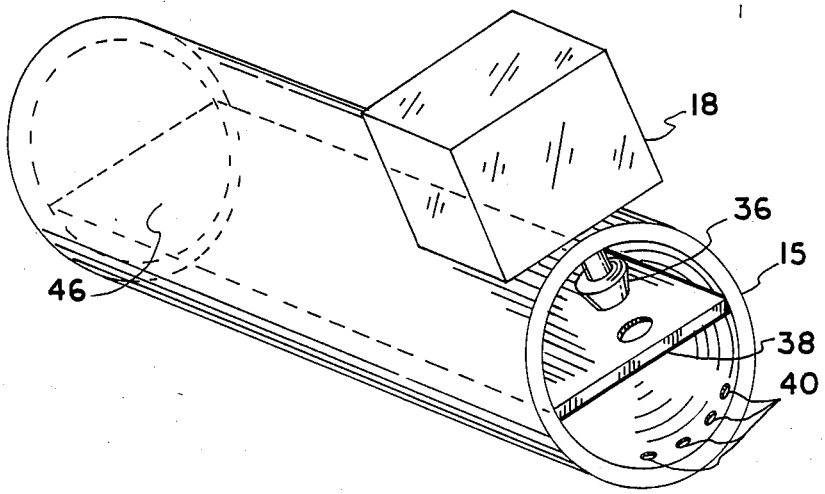
FIG. 5

APPARATUS FOR MAINTAINING SOIL MOISTURE p BACKGROUND OF THE INVENTION

1. Field of the Invention

The present invention relates to an apparatus for the maintenance of soil moisture at a specific moisture content. This invention relates more specifically to the maintenance of soil water content to preserve the foundations of houses and buildings such that they are not subject to the compressive forces of soil when the soil changes volume. Soil changes volume whenever it absorbs ground water. This is especially true when the soil is hydrated from a dessicated state.

2. Description of the Prior Art

The destruction of foundations by the expansion of soil has cost the homeowner literally billions of dollars in costly repairs. Ground soil becomes dry because of environmental conditions such as summer heat and dry air. However, when dry soil is exposed to rain, it absorbs and retains this water. In doing so, the soil expands and requires additional space to accommodate its new volume. Though the expansion is minute, the compressive forces of expanding soil can damage a stationary foundation.

The most damaging of soils is clay. It has the largest expansion volume change of most soils. Thus, when it expands, it exerts the highest forces upon a foundation even through the actual displacement of the soil is very small.

In order to alleviate the problem of foundation damage due to these forces, it is necessary to eliminate the forces exerted by the soil when it expands. One possible way to accomplish this task would be to keep the soil completely dry. However, keeping the soil dry is impractical. One would have to make sure tht the rain never reached the soil around the foundation. This task is both difficult and poses additional problems, especially if one wishes to place decorative shrubbery around the home. Without water, clearly the shrubbery cannot survive. Since it is not practical to keep the soil completely dry, the present invention has been devised.

The present invention keeps the soil at a constant level of moisture content. In this way, the soil cannot expand further, because it is already expanded to its fullest extent. When it rains, the soil cannot absorb additional moisture if it is already saturated with water.

In order to maintain a constant level of soil moisture, the soil must be continuously watered. U.S. Pat. No. 4,534,143 issued to Goines et. al. discloses such a watering device. In this patent, water is supplied to the soil surroundng a foundation in a continuous manner. However, seasonal changes will change the soil requirement for ground water. In a rainy season such as spring, the soil will require less water than in the summer when the soil is especially dry.

The existence of vegetation will also alter the requirements of soil moisture in a localized fashion. If a tree is present near a foundation, the roots will absorb more moisture from that area than if the tree were absent. Thus, there is a localized depletion of the soil moisture content. As a result, when it rains, the soil in that area will be susceptible to a greater amount of expansion than the soil that contains a larger amount of water. This expansion can put a localized stress on the foundation that can be more damaging than a constant stress over the entire foundation. This is true because the foundation will buckle at the point of higher stress than at the point of lower stress. As a result, the foundation is more likely to crack to a greater degree in this region than in the regions where the stress is continuous.

The Goines et. al. patent provides a partial solution to the problem. However, it discloses a device that provides a constant amount of water to the surrounding soil in all locations around the foundation. Although functional, this system creates an immediate problem. There is no control over the use of water. No matter the day or the season, the device provides the same amount of water to the ground soil. Thus, this invention wastes water when the soil does not need it. The present invention solves this problem by providing a method for controlling the amount of water introduced to the soil depending upon the needs of the soil given whatever environmental conditions.

Not only does the present invention provide water to the entire system on a demand basis, it also provides for a localized dispersion of water. This feature allows for an even dispersion of water around the foundation. Water can be supplied to those areas that are lacking such as those near plants and vegetation without wasting water on those areas sufficiently hydrated. The main focus of such a design is the conservation of water through its efficient management.

The present invention is additionally designed such that it can be installed both above ground and below ground. Above ground installation is particularly important when one is installing such a device to an existing home. Below ground installation is useful when the home is being built. A below ground system has the additional advantage of inconspicuousness.

SUMMARY OF THE INVENTION

Thus, it is an object of the present invention to provide a means for maintaining a constant level of soil moisture in the soil surrounding the foundation of a house or building such that the addition of water to this soil will not cause it to expand and destroy the foundation it surrounds.

It is a further object of the present invention to provide a sensing means to detect the amount of water that the soil may require at any given time, and it is an object of the present invention to anticipate the needs of the soil at any given time.

It is yet another object of the present invention to provide a soil moistening device that is fully automatic and does not require the attention of the owner of the system.

It is another object of the present invention to provide a device that can be easily installed around the foundation of an existing home.

It is also an object of the present invention to provide cost effective installation of the device around a foundation that has yet to be built as well as a foundation that has already been constructed.

It is still another object of the present invention to provide a system that can be installed both above ground and below ground depending upon the needs of the particular application.

It is yet another object of the present invention to provide water to the soil when necessary in regular cyclic intervals such that the soil has the opportunity to absorb the water it is given. This feature is provided in the effort to minimize water wastage.

It is an object of the present invention to provide water to the soil surrounding a foundation to prevent torquing of the foundation by uneven stresses.

It is yet another object of the present invention to provide th water early in the morning to minimize the evaporative losses encountered when the water is added during the middle of the day. This would especially be true if the device were installed in an above ground location.

With these and other objects in view which will more readily appear as the nature of the invention is better understood, the invention resides in the novel combination and arrangement of parts hereinafter more fully described and illustrated, with reference being made to the accompanying drawings.

BRIEF DESCRIPTION OF THE DRAWINGS

FIG. 3 is a perspective view of the system as it would appear in a below ground operation.

FIG. 4 is a top view of the system surrounding a house. Shown are the probably locations of control boxes and the zones created by the operation of the system.

FIG. 5 is a cut away perspective illustration of the piping showing an expansive detail of the control valve operation, the horizontal dividing plate, and the vertical dividing plate.

Similar reference characters designate corresponding parts throughout the various figures of the drawings.

DESCRIPTION OF THE PREFERRED EMBODIMENT

Figure 1:
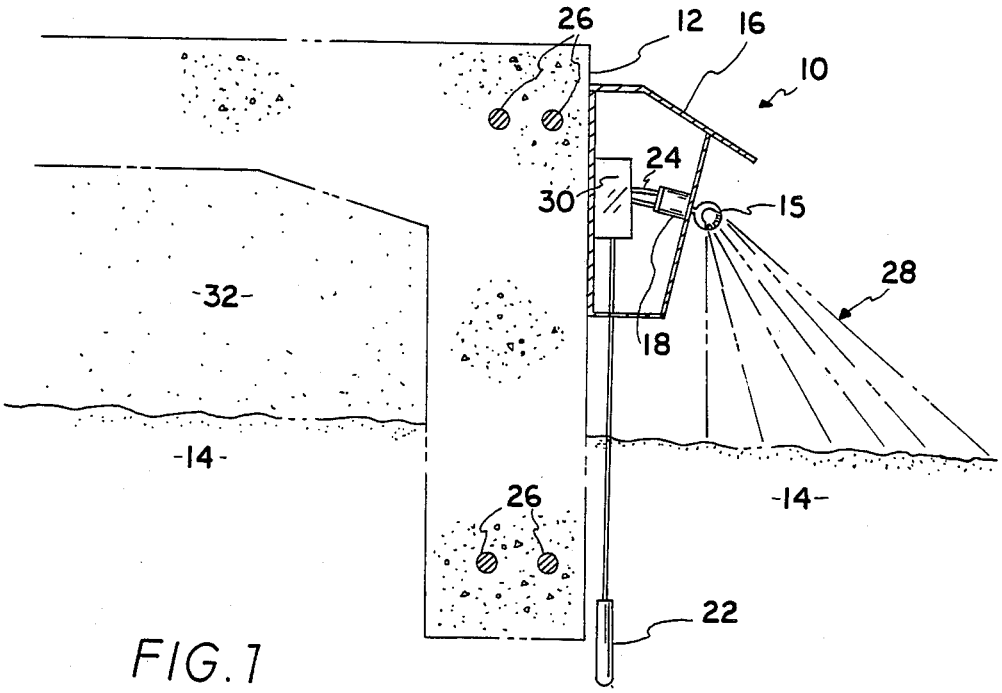
FIG. 1 is a cross-sectional view of the soil moistening system in use above ground. A control box with its associated piping and electronics is shown.
Figure 2:
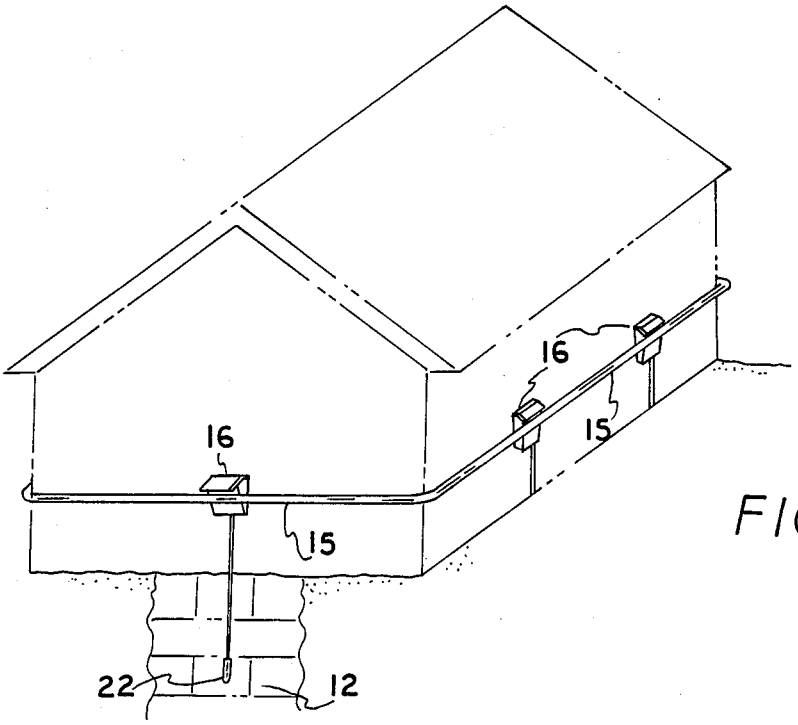
FIG. 2 is a perspective drawing of the soil moistening system in use above ground. The cosmetic appearance of the system is shown as is its probably placement along the side of a house.

The soil saturation system is generally designated 10 in each of the figures. It is a system comprised of a few components. The system operates by placing piping 15 around the periphery of the house 34. The device is designed such that it may be placed both above ground and below ground. The above ground application is foreseen to be most useful in those cases where the house 34 is already in existence. The below ground application is foreseen to be most useful in those cases where the house 34 is under construction, specifically after the foundation 12 has been built.

Spaced at regular intervals along the length of the piping 15 are control boxes 16. These control boxes 16 are the means whereby the flow of water is controlled for a specific length of piping 15. Only one inlet port to the system need be provided to the system although more may be preferred. The inlet port may be as simple as faucet external to the house 34. In the above ground installation, the system 10 is designed such that it can be attached to the external faucet of a house for its supply water.

The piping 15 of the system 10 is divided along its length into two internal regions by a dividing plate 38. The upper region 42 is the region that carries water. The lower region 44 is normally devoid of water. The lower region is provided with a plurality sprinkler perforations 40 along its length so that when water is introduced to this lower region, the water is sprayed onto the soil 14 a good distance from the system 10 itself. The water should be sprayed between 1–5 feet from the wall upon which the system 10 is mounted for maximum benefits.

The control boxes 16 are simply housings to protect the electronic internals therein. The primary component within a control box 16 is the control valve 18. When actuated, the control valve 18 raises its plug 36 which normally fits snug in the perforation of the horizontal dividing plate 38. In lifting the plug 36, the control valve 18 allows water to flow in to the lower region 44 from the upper region 42. The water, pressurized to 60 psi, a standard household water pressure, is then sprayed out of the lower region 44 through the sprinkler perforations 40.

Also located within a control box 16 is an electronic processor 30. It is connected by wiring 24 to an electronic probe 22 beneath the surface of the soil 14. It is the functon of the electronic probe 22 to sense the water content of the soil 14. When the water content falls below the threshold determined to be needed, a signal is sent to the control valve 18 from the electronic processor 30. The signal causes the control valve 18 to open. When the electronic probe 22 sense that the water content has been appropriately met, a signal is sent from the electronic processor 30 to the control valve 18 to close. This shuts off the water until needed.

In an above ground application, the water is sprayed from the lower region 44 onto the surface of the soil 14. However, in a below ground application, the lower region 44 should be positioned such that its curved surface faces away from the wall surface upon which it is mounted. This causes the spray to become directed away from the wall in up to one hundred and eighty degree fashion and assures saturation of the surface layers of soil as well as the lower layers. The sub-surface application is preferably not place more than a foot below the surface of the soil 14 such that the surface soil 14 layer is also saturated.

Located midway between each of the control boxes, there is an additional feature of significance. In the lower region 44, this feature is called the vertical dividing plate 46. The vertical dividing plate 46 allows separation of the piping along its length into sections such that only a fraction of the piping may be activated at any given time. The upper region 42 is continuous and undivided. Thus, no matter the soil moistening zone 20 which needs water, there is always a supply of water.

The arrangement of control boxes 16 at the periphery of the house 34 allows for regional watering. If one soil moistening zone 20 is more demanding than anther, more water can be applied to that soil moistening zone 20 than the others. In addition to spot watering, the entire system can be controlled by a master processor 48 located within the house 34. This master processor 48 could be programmed such that it provides the entire periphery of the house 34 with water in the morning hours when evaporative effects of the water are least significant. The system could be programmd such that the water is supplied to the soil 14 in fifteen minute intervals which would maximize water absorption and minimize water runoff and wastage. The master processor 48 would have superior control over the independently acting local electronic processors 28 and, thus, have overriding control over all of the control valves 18 at the any given time.

Figure 6:
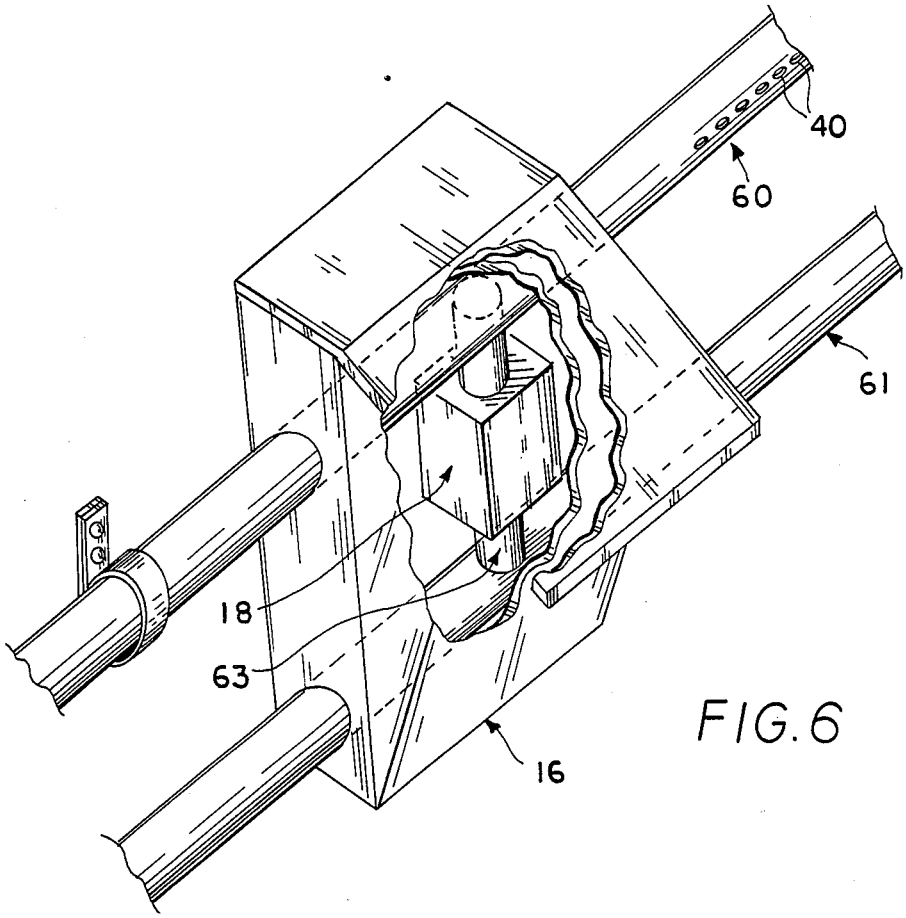

FIG. 6 illustrates an alternate embodiment of the present invention where the piping of the soil moistening system 10 is divided into two separate pipes. In this particular embodiment, there is a supply line 61 and a sprinkler line 62. Both lines, 61 and 62 extend around the periphery of the house 34. The sprinkler line 62 is shown above the supply line 62 through this arrangement may be reversed depending upon the specific application. At the location of the control boxes 16, a small connection line 63 extends from both the supply line 61 and the sprinkler line 62. The connction lines 63 connect their respective line to the control valve 18 and to one another.

When the soil moisture is found low, the control valve 18 opens allowing water to pass from the supply line 61 to the sprinkler line 62. The water sprays out from the sprinkler perforations 40 provided in the sprinkler line 62. The sprinkler line 62 contains a number of vertical dividing plates 38 along its length to provide the same control of flow as in the preferred embodiment described above.

It is to be understood that the present invention is not limited to the sole embodiment described above, but encompasses any and all emodiments within the scope of the following claims.

I claim:

1. A soil moistening apparatus for the periphery of a house, building, or the like comprising:

a water supply means comprising piping, a water sprinkling means comprised piping, said water sprinkling means having a plurality of perforations allowing for the discharge of water, said water sprinkling means being divided into sections along its length by a plurality of vertical dividing plates, said water sprinkling means having along its length in at least one position between said vertical dividing plates a control valve means whereby the flow of water may be selectively controlled into the sections of the sprinkler means, and said water supply means connected to said water sprinkling means.

2. A soil moistening apparatus according to claim 1 including:

an electronic probe means, said electronic probe means sensing the water content of the soil in which it is placed, said electronic probe means sending a signal to an electronic processor when said soil requires moisture and when said soil is sufficiently hydrated, whereby said processor interprets said signal from said electronic probe means and sends an appropriate signal to said control valve means either to open or close said control valve means to permit or restrict water flow to said water sprinkling means, and a central processor located within the periphery of said house, building or the like providing an overriding control of all of said independent processors.

3. A soil moistening apparatus according to claim 2 wherein, a control box is included, said control box providing a housing to protect from environmental conditions said electronic procesor and said control valve means, said control box being composed of a material which can resist the effects of weathering, and said control box having a lid hingeably mounted to its rear portion such that said lid can be opened for access to said electronic processor and said control valve means.

4. A soil moistening apparatus according to Claim 1 wherein, said water supply means and said water sprinkling means are combined into a length of piping divided along its midplane along its entire length into an upper and lower region by a horizontal dividig plate, said lower region is equivalent to said water sprinkling means, said upper region is equivalent to said water supply means, said piping being divided in said lower region at regular intervals by a plurality of said vertical dividing plates, said piping being riddled in its lower region by plurality of said perforations, and said horizontal plate having a plurality of perforations along its length at the locations of each of said control valve means.

5. A soil moistening apparatus according to claim 4 wherein said control valve means comprises:

a drive mechanism external to said piping, a drive shaft extending from said drive mechanism into said upper region of said piping, and a plug fixed to the end of said drive shaft within said upper region of said piping allowing for the opening and closing of said perforation of said horizontal dividing plate.

6. A soil moistening apparatus according to Claim 4 wherein, said soil moistening apparatus is mounted to the side of said house above the level of the ground, and said horizontal dividing plate runs parallel to the ground when said soil moistening apparatus is attached to the side of said house above the level of the ground.

7. A soil moistening apparatus according to claim 4 wherein, said soil moistening apparatus is mounted to the side of a foundation just below the level of the ground, and said horizontal plate runs parallel to the side of said foundation when said soil moistening apparatus is attached to the side of said foundation below the level of the ground.

8. A soil moistening apparatus according to Claim 1 wherein, said water sprinkling means is an independent sprinkler line, said water supply means is an independent supply line, connection lines to connect said supply line and said sprinkler line to said control valve means, and said control valve means containing a stop means to permit or restrict water flow to said independent sprinkler line.

* * * * *